US005408982A

United States Patent [19]

Doornenbal

[11] Patent Number: 5,408,982

[45] Date of Patent: Apr. 25, 1995

[54] DRAW FORCE ATTENUATION SYSTEM FOR A BOW, PARTICULARLY A RECURVE BOW

[76] Inventor: Johannes Doornenbal, 16348 Van Allen Rd., Escalon, Calif. 95320-9770

[21] Appl. No.: 475,400

[22] Filed: Feb. 5, 1990

[51] Int. Cl.[6] ..... F41B 5/00; F41B 5/10

[52] U.S. Cl. ..... 124/23.1; 124/25.6

[58] Field of Search ..... 124/23 R, 24 R, 86, 124/88, 23.1, 24.1, 25.6

[56] References Cited

U.S. PATENT DOCUMENTS

| | | | |
|---|---|---|---|
| 3,993,039 | 11/1976 | Groves et al. | 124/23 R |
| 4,287,867 | 9/1981 | Islas | 124/24 R |
| 4,457,288 | 7/1984 | Ricord | 124/23 R |
| 4,646,708 | 3/1987 | Imes | 124/24 R |
| 4,667,649 | 5/1987 | Humphrey | 124/25.6 |
| 4,781,168 | 11/1988 | Lester | 124/25.6 |
| 4,858,588 | 8/1989 | Bozek | 124/23 R |
| 4,903,677 | 2/1990 | Colley et al. | 124/23 R |

*Primary Examiner*—Eric K. Nicholson
*Assistant Examiner*—John Ricci
*Attorney, Agent, or Firm*—Bernhard Kreten

[57] ABSTRACT

An archery bow where the individual limbs can be independently tuned at an area where they connect with top and bottom portions of the handle. The tuning is coupled with a connection structure which lengthens the moment arm that had heretofore been used in connecting limbs to the bow's handle to reduce the amount of force required to hold the bow in a drawn, cocked position and alter the force profile along the stroke of the draw by increasing the force administered to the arrow on release of the string.

33 Claims, 4 Drawing Sheets

DRAW FORCE ATTENUATION SYSTEM FOR A BOW, PARTICULARLY A RECURVE BOW

FIELD OF THE INVENTION

The following invention relates generally to an instrumentality for altering the draw force pattern for an archery bow, particularly a recurve bow. More specifically, the instant invention is directed to an instrumentality which reduces the force required to maintain the bow in a drawn, cocked position and changes the force profile required to extend the bow to this cocked position.

BACKGROUND OF THE INVENTION

Historically, excellence in archery has been the sole criterion by which one had been evaluated as a provider for food for one's family. More recently, excellence in archery determines success during the brief hunting periods allowed for archers and determines also their success in competitive archery events.

Not surprising, therefore extremely subtle nuances have been relied upon in order to distinguish competitive archers. One variable involves the fact that the tension required to pull the bow string to a drawn, cocked position is not constant. This is particularly true along the length of the pull required to stress the limbs or the bow prior to firing the arrow. Indeed, a myriad of contrivances have been developed which alters the force pattern required to deform the limbs of the bow.

The following patents reflect the state of the art of which applicant is aware, insofar as these patents appear to be germane to the patent process. These patents are disclosed with a view towards discharging applicant's acknowledged duty to disclose relevant prior art. However, it is respectfully submitted that none of these patents teaches the claimed invention when considered singly, and none of the patents renders obvious the instant invention when considered in any conceivable combination.

| INVENTOR | PATENT NO. | ISSUE DATE |
|---|---|---|
| STORER | 3,595,213 | July 27, 1971 |
| NISHIOKA | 3,744,473 | July 10, 1973 |
| KETCHUM | 3,990,425 | Nov. 9, 1976 |
| JONES | 4,227,509 | Oct. 14,1980 |
| SIMONDS, et al. | 4,368,718 | Jan.18,1983 |
| SIMONDS | 4,438,753 | March 27, 1984 |
| HAYES | 4,478,203 | Oct. 23,1984 |
| JENNINGS | 4,561,413 | Dec. 31, 1985 |
| KUDLACEK | 4,593,674 | June 10, 1986 |
| CHATTIN | 4,724,820 | Feb.16,1988 |

The patent to Chattin teaches the use of a bowstring modification which allows a conventional long bow or a recurved bow to be held in a drawn loaded position requiring less force. In essence, this patent teaches the use of a cam-type element interposed along the length of the bow string to alter the amount of force by changing the mechanical advantage associated with cocking the bow. However, where this patent is conceptually similar to the present invention, it also is structurally distinct.

The remaining citations diverge even further from that which is the claimed nexus of the instant invention.

SUMMARY OF THE INVENTION

The instant invention is distinguished over the known prior art in a plurality of ways. One apparent, yet profound difference involves the elegance and simplicity in the design of the instant invention when contrasted over the known prior art. Whereas many prior art devices, particularly compound bows, require a complex series of pulleys and associated cables to offset the load imposed by the tension programmed into the bow's limbs, the instant invention is free from the complex maze of pulleys and cables.

A second distinction involves the placement of the draw force equalizing and altering instrumentality according to the instant invention, when compared to the known prior art. Whereas the prior art includes a plurality of mechanical advantage saving devices connected at limb extremities, the instant invention's benefits are obtained by maintaining the profile of the bow substantially unaltered. Therefore, besides providing an aesthetically pleasing contour, a minimum number of projections are provided which could provide a snag when hunting in inhospitable terrain.

The third benefit which sets the instant invention apart from the known prior art involves the ability to alter and therefore tune the force profile of each limb, substantially independent of-the other limb. Whereas the prior art devices normally provide mechanical advantage at the limbs extremities and extend those advantages directly to the opposed limb, each limb according to the instant invention is somewhat isolated from-the other limb, except for the conventional draw string that extends between limb extremities. This means that subtle changes with respect to the force required to distort only one of the limbs can be made. Coupled with the other limb, the trajectory of the arrow can be altered.

The instant invention intends to alter the known prior art force profiles which heretofore have required substantially greater force in holding the bow string taut when the bow is in the drawn, cocked position. Theoretically, it is desirable to have the force required to draw the bow from an at rest position to a fully-cocked position to be substantially constant along the length of the draw. When the draw force is substantially constant along the length of the draw, the force imparted upon the arrow after releasing the draw string will also be substantially constant. This means that the accelerating force imposed upon the arrow will be constant for the entire time the arrow is being driven by the draw string. If the acceleration is constant, a lighter arrow can be used because the problem of having an arrow accelerate initially at a greater rate than the force imparted by the draw string will have been obviated.

Stated alternatively, when the arrow is at rest and the draw string is at its full, drawn, cocked position, the initial physical impediment that must be overcome is the inertia of the at-rest arrow. A lighter arrow will accelerate more quickly than a heavier arrow with the same quantum of force. Uniform force applied to the arrow when being propelled by the draw string results in a truer flight because force gradients will not impart unwanted "pulsing" on the arrow. Because the arrow accelerates more quickly, the unavoidable (non theoretical) drop off in draw string propelling force is not as objectionable and will not distort the arrow's flight. This is particularly true in the instant invention because its drop off is more gradual and less severe. Thus, heavier arrows, which were required to offset the rapid precipitous drop off in propulsive forces are not needed.

Briefly, these features are achieved in the instant invention by the provision of a structure in which the limbs of the bow are loosely attached to the bow's handle in a substantially overlapping manner, wherein portions of the handle contact portions of each limb. A cable extends between the handle and each limb, and this cable terminates substantially intermediate-the extremity of each limb. Thus, two cables are provided, one going to each limb. One end of each cable is attached to a portion of the handle.

Upon tensioning the bow with the bow's draw string, the cables oppose the tendency of the draw string to dislodge the limbs from their attachment with the handle. Further tensioning with the draw string by cocking the draw string imparts greater force on the cable which affects this distortion, providing the benefits of the instant invention, inherent in this design.

The exact placement of the cable's end on each limb defines one variable with respect to altering the draw string force profile. In addition, placement of the cable's other end with respect to a central portion of the handle also alters this characteristic. Benefit can be derived from micro-adjusting these variables.

OBJECTS OF THE INVENTION

Accordingly, it is a primary object of the present invention to provide not only a novel and useful archery type bow according to the present invention but also an improvement to the arts and sciences as contemplated by the United States Constitution under Article One Section Eight.

A further object of the present invention is to provide a device as characterized above which is able to alter a force profile associated with distorting a draw string of an archery bow from an at rest position to a cocked position.

A further object of the present invention is to provide a device as characterized above which is extremely durable in construction, safe to use, and lends itself to mass production techniques.

A further object of the present invention contemplates providing a device as characterized above in which it is less fatiguing to hold the bow in a drawn, cocked position than heretofore because the force required is substantially less than known prior art devices.

A further object of the present invention is to provide a device as characterized above which enables micro-adjustments to the bow to be effected, thereby allowing an archer to fine tune his bow for his own shooting style, preferences and peculiarities of the instant shooting environment.

Viewed from one vantage point, it is an object of the present invention to provide a bow which has a central handle, a pair of limbs linked to the handle such that one limb extends from a top portion of the handle and another limb extends from a bottom portion, a draw string connecting the limbs at limb extremities remote from the handle, and an instrumentality minimizes the requisite force required to hold the bow in a drawn, cocked position where the force is minimized by the instrumentality being connected between the handle and each limb, terminating intermediate the extremity of each limb.

Viewed from yet a further vantage point, it is an object of the present invention to provide a method for altering the force profile required to deform a bow to cock the bow the steps including; providing an overlapping fit between each bow limb where it attaches to a bow handle, connecting each limb to the handle by a cable running from the handle to each limb, connecting opposed extremities of the limbs to each other with a draw string, whereby the cable alters the force profile required to bend the limbs via the draw string.

A further object of the present invention is to provide a draw force equalizer system for archery bows in which, once the arrow is released, the power stroke causes the arrow to be propelled with greater velocity because the forces imparted to the arrow gradually increase as the arrow is released and before it leaves the bow string. This occurs because although the arrow apparently resides on the bow string for a similar duration as the prior art, *the force profile is greater.

With particular respect to the instant invention as it pertains to a recurve type of bow, an object of the present invention is to provide a device which stores more energy than bows of comparable weight rating. Notwithstanding the additional energy storage capability of the instant invention, an object of the instant invention is to provide a bow which is very quiet when compared to prior art devices because of reduced limb vibration upon release of the draw string.

A further object of the present invention is to provide a device as characterized above which, due to its simplicity in design can be easily disassembled and reassembled for storage or transport.

A further object of the present invention is to provide a device as characterized above which accommodates the use of lighter arrows based on the smoother power stroke of the bow, to therefore also provide more arrow speed.

These and other objects will be made manifest when considering the following detailed specification, when taken in conjunction with the appended drawing figures.

BRIEF DESCRIPTION OF THE DRAWING FIGURES

BRIEF DESCRIPTION OF THE PREFERRED EMBODIMENT

Figure 1:
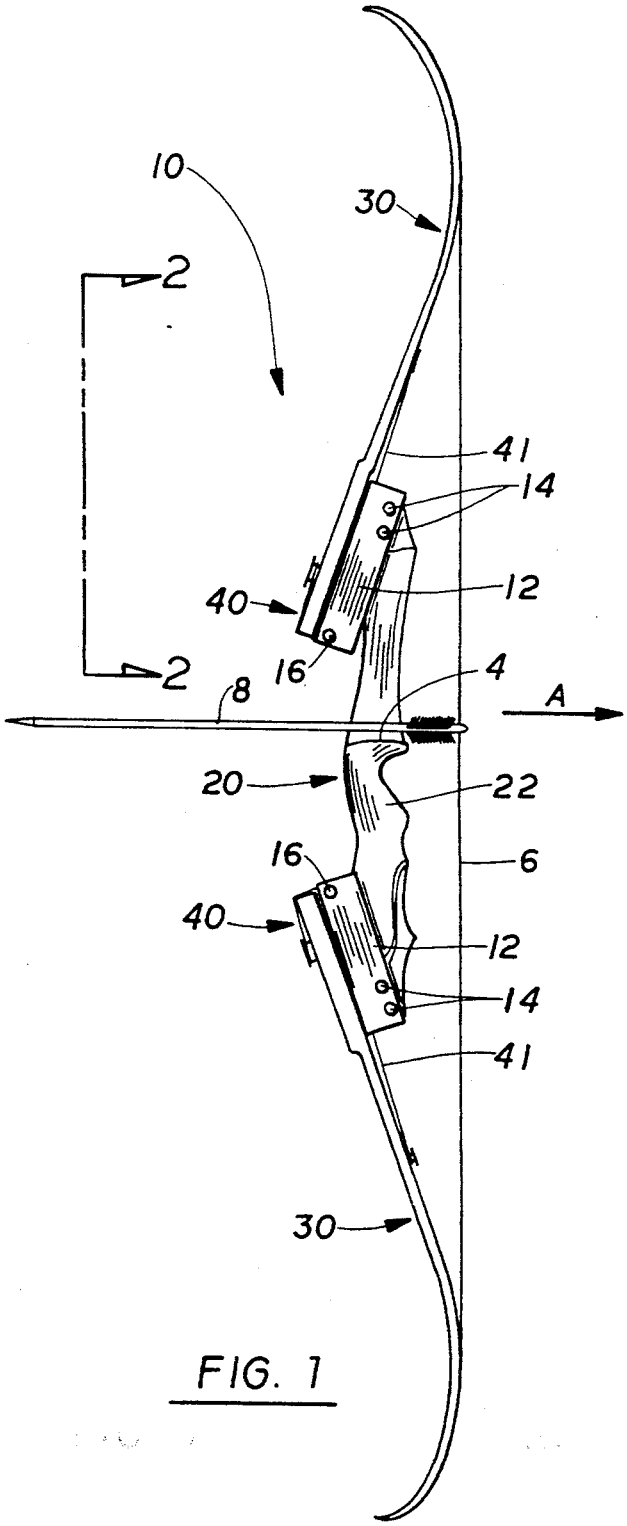
FIG. 1 is a side view of the apparatus according to the present invention.

Referring to the drawings now, wherein like reference numerals refer to like parts throughout the various drawing figures, reference numeral 10 is directed to the self-adjusting recurve bow according to one form of the invention and evident in FIGS. 1 through 5. Reference numeral 50 is directed to a second form of the bow providing similar draw force self-adjusting characteristics and evident in FIGS. 7 and 8.

Figure 2:
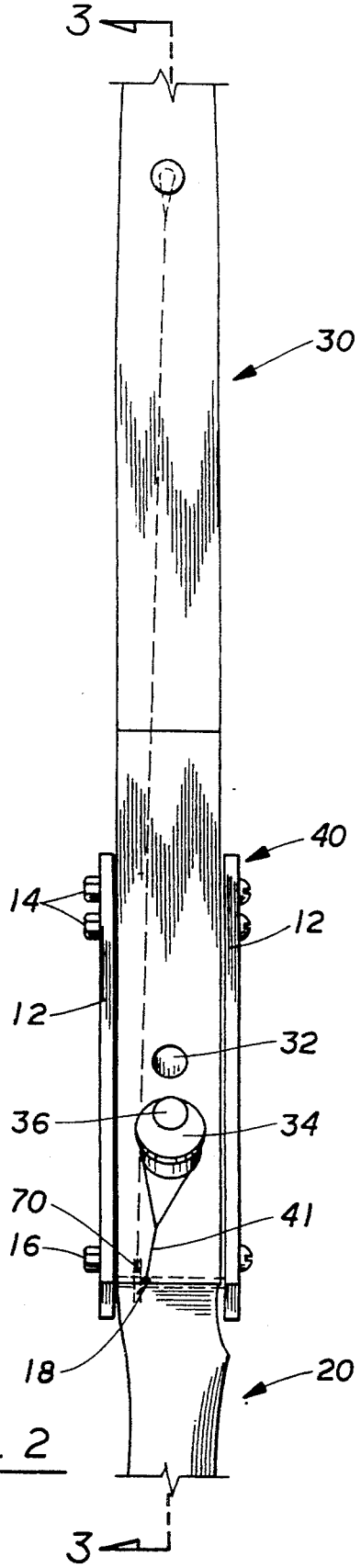
FIG. 2 is a front view of a portion of FIG. 1, taken along lines 2—2 of FIG. 1.
Figure 3:
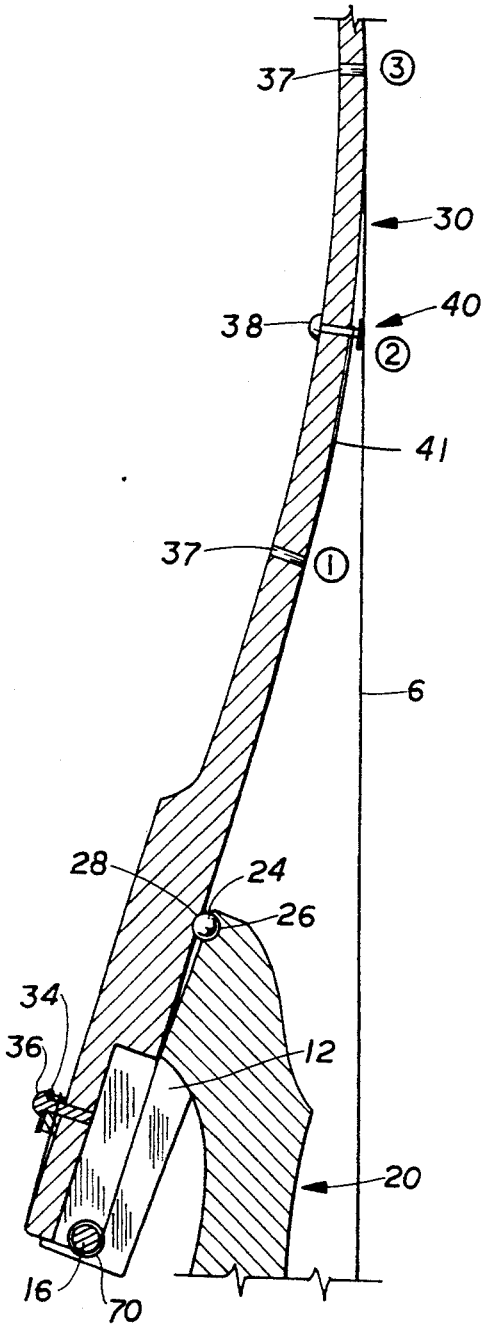
FIG. 3 is a side view of that which is shown in FIG. 1, in greater detail.
Figure 4:
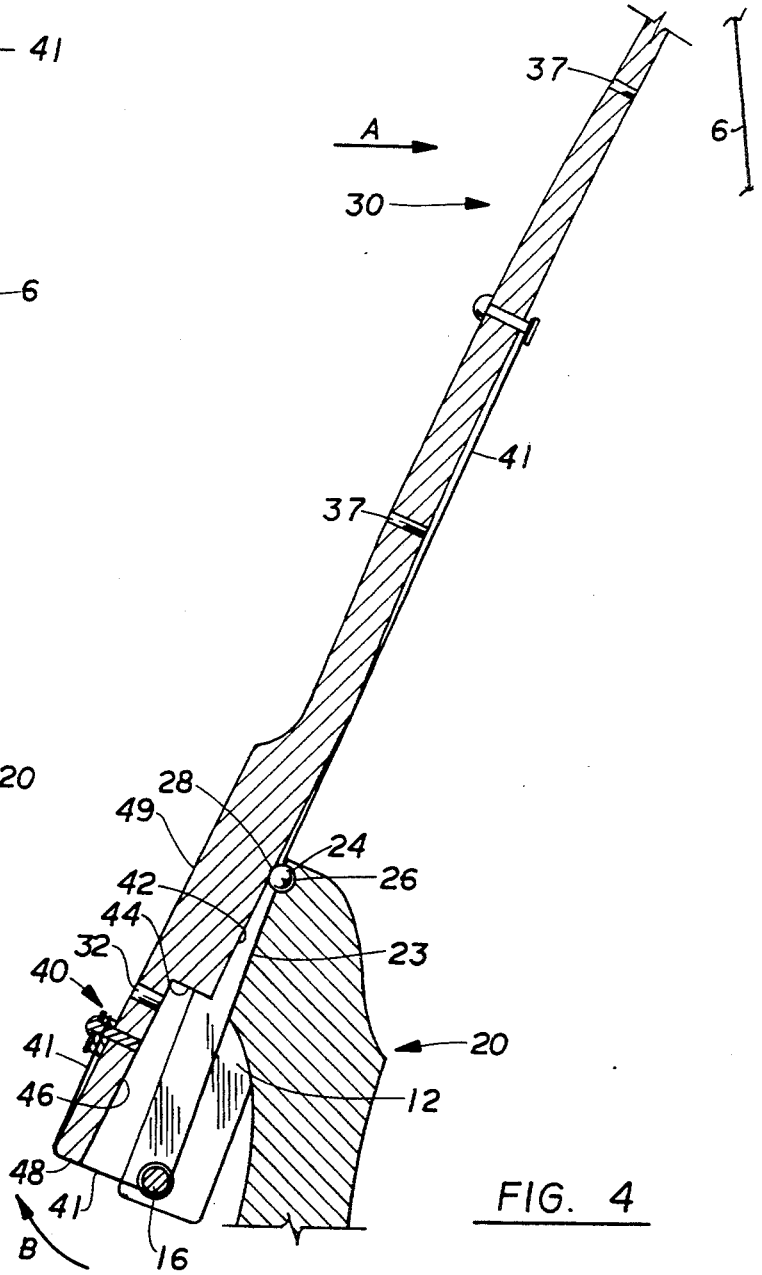
FIG. 4 is a view similar to FIG. 3 but showing the bow limb in a stressed position.

In its essence, the bow of FIGS. 1 through 5 includes a handle area 20, a pair of limbs 30, and a means for minimizing the requisite force required to hold the bow in a drawn, cocked position, the force minimizing means 40 generally depicted as 41. When the bow is to be cocked, by pulling the bow string 6 in the direction of the arrow A, the limbs 30 of the bow flex also in the direction of the arrow A. This causes the lower portion of limb 30, where it attaches adjacent the handle 20 to rotate in the direction of the arrow B as shown in FIG. 4. This rotation is opposed by the cable 40 which at least partially defines the force minimizing means.

More particularly, the handle 20 includes a grip area 22 of the type having an ergometric contour to comfortably accommodate the hand of the person. Typically, the grip 22 will be contoured and molded to accommodate either a person grasping with one's left hand or right hand. In addition, the handle 20 includes an arrow shelf 4 so that the arrow 8 can be supported thereon, in a desirable manner.

As shown in the drawing figures, two limbs 30 are provided: an upper limb connects to a top portion of the handle 20 and a lower limb connects to a bottom portion of the handle. FIGS. 2 through 4 detail the fastening features of the top limb to the top portion of the handle, although an analogous mechanism can be pictured for the lower limb and the lower handle portion.

Each handle 20 includes a pair of spaced parallel guide plates 12 on lateral sides of the handle. Although these guide plates 12 are shown bolted via bolts 14 to the handle, it is contemplated that a handle could be made which integrally has these guide plates fabricated therewith. Thus, the illustrative embodiment evokes a structure reminiscent of a kit, but this should not be construed as a limitation. These guide plates 12 are oriented such that a projection of the guide plate extends downwardly and to the front of (i.e. on a side opposite from the draw string 6) the handle. Thus, a free end of the guide plate 12 is cantilevered to extend downwardly and forwardly of the handle of the bow, directed towards an arrow 8 shown in FIG. 1. The cantilevered end of the guide plate supports an axle 16 thereon. The axle 16 in turn supports a mechanism for changing direction of the cable 41, configured in FIG. 5, for example as an idler pulley 70. In the alternative a cam cotlid be mounted on the axle 16, rather than an idler pulley. See for example the eccentric cam in FIG. 4, numeral 16. Also, a guide for cable 41, to keep the cable on track could be grooved on axle 16.

The limb 30 has an inner wall 42 that faces the draw string 6. This inner wall 42 directly contacts a top wall portion 23 of the handle 20 in a substantially tangential, coplanar fashion, interrupted only by a fulcrum area defined by a pair of ball bearings 24 provided in a ball bearing seat 26 carried on the handle and a complementally formed seat 28 on the limb 30. But for the ball bearings, the portion of the limb having its inner surface 42 would be flush with the wall 23 at the top portion of the handle. The limb 30 also includes a step 46 adjacent its lower-most end, nearest the axle 16. The step 46 communicates with the inner wall 42 by means of a stair type riser 44 providing a transition therebetween. Thus, when viewing the lower extremity of the limb 30 as shown in FIG. 4, the limb has a relatively thick area adjacent its contact with the handle near the ball bearing 24 and the wall 23 of the handle, and then has a narrow tapered portion at its free end. Notice also that the limb 30 tapers as it extends upwardly away from the handle. The step 46 continues rearwardly and communicates with an end wall 48 of the limb. Thereafter, the limb has an outer wall 49.

The limb 30 also includes a bore 32 which is a standard feature on many bows since this bore 32 heretofore would have admitted a bolt (not shown) therethrough for attachment to the handle in a complementally formed threaded blind bore contained within the handle. The bore 32 still has utility in the instant invention especially when assembling the limb to the handle. However, it has no function when the bow has been assembled and should be removed for utilization, to benefit from the invention. Heretofore, the recurve bow would have been solely supported by a pair of ball bearings 24 and the bolt passing through the bore 32 fastened to the handle. The amount of flexure in the prior art would only have been above the bolt hole 32 towards the free end of the limb 30.

Rather, a cable 41 extends between an intermediate portion of the limb 30 and communicates along the inner wall 42 of the limb, between the limb and the handle wall 23, and is placed over the axle 16 and idler pulley 70 or, in the alternative cam over the end wall 48, and extends on the outer wall 49 connecting a free end of the cable 41 to an attachment cam adjuster 34 fastened through the lower most extremity of the limb via a shaft 36. As shown, the upper, remote end of the cable 41 is attached to the limb via a coupler such as a nut and bolt 38.

As thus far described, when the arrow is to be fired, the bow is cocked by pulling the bow string 6 in the direction of the arrow A shown in FIG. 1. This provides distortion of the limb 30 also in the direction of the arrow A suggested in FIG. 4. This distortion provides flexure along the length of the bow limb 30. Heretofore, with a bolt fixed through the bore 32 and via the ball bearings 24, any distortion of the limb would occur substantially above the ball bearing 24 and above the handle 20. With the arrangement thus far described, the tendency of the limb to flex can be controlled by the cable 41 which extends between the attachment area 38 on the limb and the cam adjuster attachment 34. Since the axle 16 is connected to the guide 12 the magnitude of flexure is limited by the elasticity of the cable 41. Thus, cable distortion coupled with flexure along the entire length of the limb can control the force profile associated with drawing the bow to a cocked position.

Figure 6:
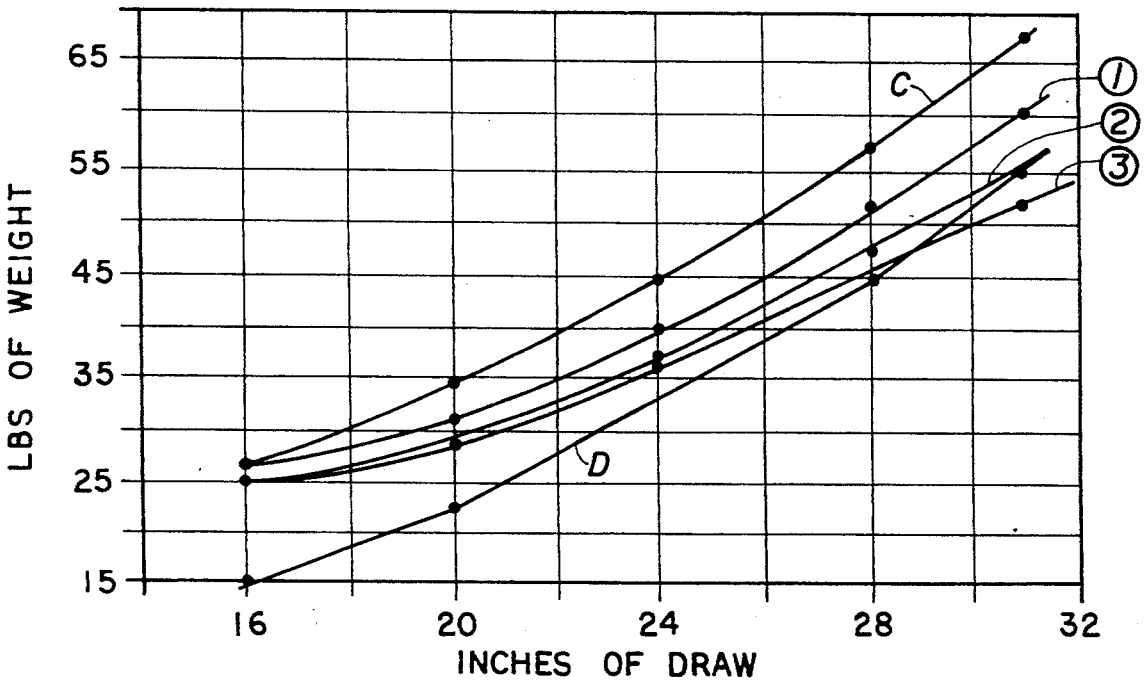
FIG. 6 depicts graphical data of the improved characteristics of the instant invention when compared to the known prior art.

FIG. 6 reflects the ability the instant invention has to alter the requisite force profile for an archery bow providing certain micro adjustments. More particularly, five different curves are shown on a graph which compares inches of draw to the requisite number of pounds of force required to effect this draw. The top most curve, bearing the legend "C" reflects a conventional recurve bow prior to any modification. "D" shows a standard 55 pound bow. Curves 1, 2 and 3 show the alteration of the pounds of force required visa vis inches of draw for the embodiment just discussed. As shown, in all cases the amount of force required to keep the bow drawn, particularly at its maximum draw that is (approximately 30 inches) is substantially less, ranging between 8 and 18 pounds difference compared to the conventional bow. At minimum draw, approximately 16 inches, the force required for all three variations and the conventional bow is virtually the same, within 3 pounds of one another.

Graph curves 1–3 show test data reflecting placement of the attachment area 38 or bores 37 at three different distances from handle 20, with curve 1 closest to the handle, and curve 3 furthest from-the handle.

These profound differences may be explained by the fact that the effective moment arm of the lever has been changed. Whereas the fulcrum still is at the site of the ball bearings 24, in the conventional bow the downstream moment arm stops at the bolt hole 32. In the present invention the full resiliency of the limb is utilized since the length of the moment arm now has been extended to where the axle 16 and idler pulley or cam connects to the guide 12.

A further variable exists by virtue of the cam adjuster 34 as it attaches to the free end of the cable 41. Tension in the cable 41 can be adjusted by rotation of this cam adjuster 34. In addition, it should be appreciated that the attachment 38 on the limb extremity, remote from the handle is variable. The attachment 38 can be moved up or down the limb as suggested by placement of the bores 37 along the length of the limb. In this manner, each limb can be separately tuned with respect to resiliency, spring back and other characteristics to suit the personal predilection of the archer. An ideal model, utilizing all of the above variables, would have a goal of providing a substantially flat line on the FIG. 6 graph, indicating linear "pull" along the entire "stroke".

Unlike other prior art devices, this system directly effects the resiliency of the limb and is not necessarily transferred to the opposite limb via the draw string 6. For example, the cam adjuster setting on an upper limb could vary visa vis the lower limb which would alter the effective moment arm of that limb for its spring return rate. This would allow an archer to tune his bow as would be his own shooting style preference.

It should be kept in mind that most limbs are formed from hardwood laminates and although manufacturers may take extreme care to assure that the limbs "match" the structure, the instant invention can assure that the limbs match to the specific preferences of the user. For example, proper cable tension can be verified either by feel, or for example with a tuning fork.

Figures 7, 8:
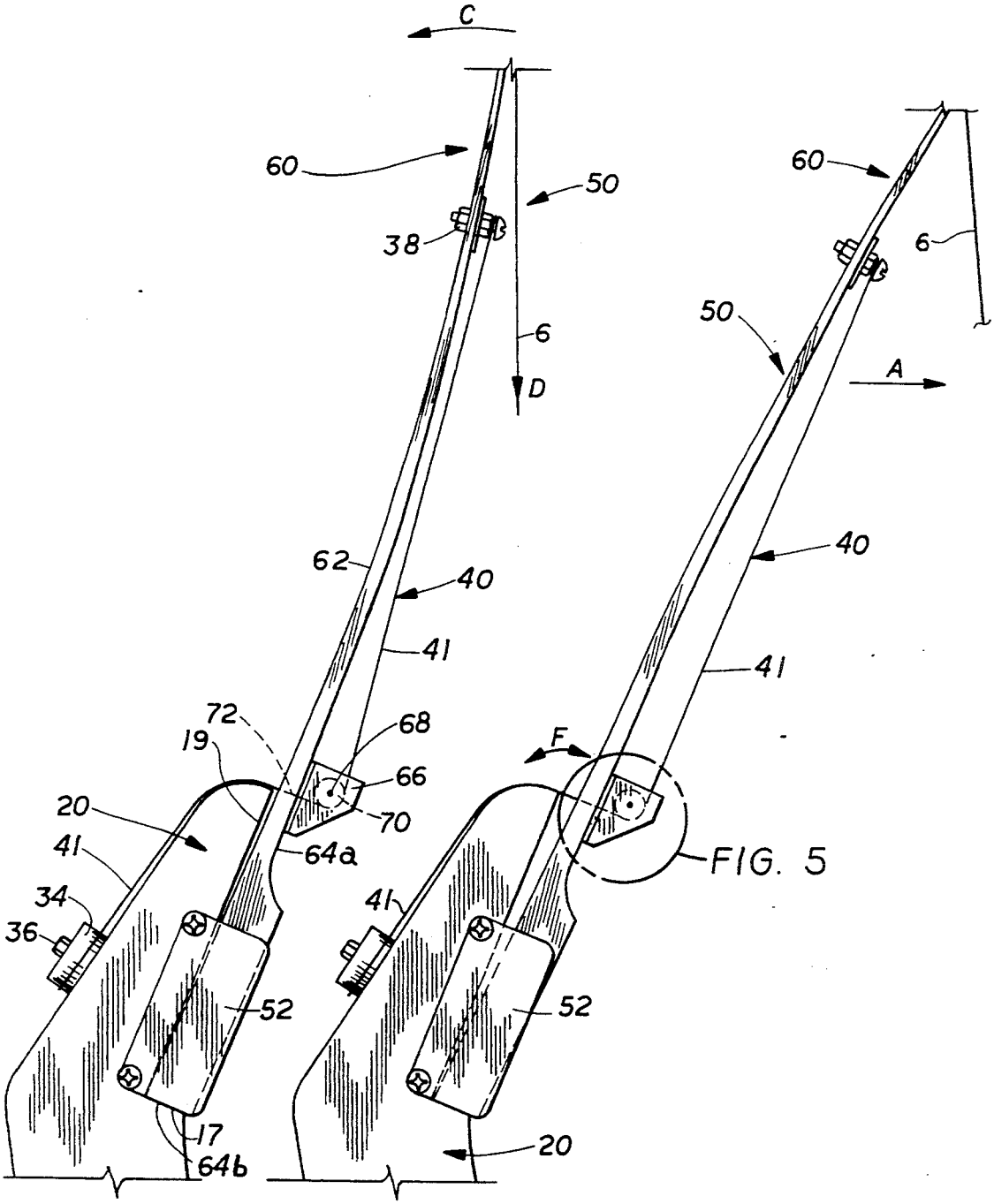
FIG. 7 depicts a bow according to a second form of the invention.
FIG. 8 shows the FIG. 7 bow in a stressed position.

Attention is now directed to FIGS. 7 and 8 of the instant invention which describe a further variation operating under the same physical principals as heretofore discussed. Only the salient differences will be explored.

Whereas the earlier embodiment lent itself to retrofitting on existing bows to a certain degree, it still required the use of ball bearings which could be dislodged and lost. For example, should the draw string 6 break, the limbs according to either embodiment are not rigidly attached to the handle and therefore would not provide the requisite counter balance when the draw string was broken resulting in rapid bow disassembly. Looking for a ball bearing in the wilderness may alter an archer's hunting plans. The embodiment of FIGS. 7 and 8 require no ball bearings.

Moreover, although the cable is still routed forward the handle 20, the limb 60 is routed rearward the handle 20 in this embodiment. Thus, the guide plates 52 are attached so that projections extend rearwardly and are not cantilevered out in the same manner as FIGS. 1 through 5 since a sidewall of the guide plate is connected to the handle as opposed to an end wall. In addition, the limb 60 has a first wall 62 remote from the draw string 6 which abuts against a complementally formed wall 19 on the handle and an end wall **64*b* which abuts against a bottom wall 17 as the sole areas of tangency. The limb is free to ride away from its having been nested within and between the guides 52 if it were not for the countervailing forces existing between the cable 41 and the draw sting 6** as will now be described.

More specifically, a surface **64*a* of the limb facing the draw string 6 includes the idler pulley or cam mechanism discussed with the FIG. 1 through 5 versions. More specifically, a pair of ears 66 extend from the surface 64*a* of the limb facing the drawstring 6. These ears support an axle 68 upon which a means for changing directions such as an idler pulley or a cam 70 is provided. The idler pulley or cam 70 can be build to allow adjustments. A hole 72 is provided in the limb 60 to allow the cable 41 to pass over the idler pulley or cam 70 through the limb via bore 72 and then to an outside surface of the handle where the cable 41 then attaches to a cam adjuster 34 via shaft 36. Thus, the force D engendered by the draw string 6 shown in FIG. 7 is opposed by the tension associated with the cable 41 via its connection at cam adjuster 34 and this holds the limb in place. Without the draw string 6, the limb 60 would be free to move in the direction of the arrow C shown in FIG. 7. The draw string D opposes this and places the requisite tension on the limb. When the bow is to be cocked by applying the force in the direction of the arrow A as discussed above, additional force D along the length of the drawstring 6 is influenced by the vector A. As should be evident, the vector A increases the force along the length of the draw string 6 which is opposed by the cable 41. This force can be altered because now the pivot point is 68. In the former case the pivot point was found at the location of the ball bearing. Flexing "F" is opposed by the distance between the shaft 68 and a lower shoulder 64*b***. Thus, the entire length of the limb is utilized.

FIG. 6 shows the force characteristics relying on the structure discussed in FIGS. 7 and 8. As can be shown, the inches of draw versus the pounds of force are illustrated by the curves bearing reference numerals 1, 2 and 3. Not only has the total force required to maintain the bow at maximum draw been appreciably diminished, but the amount of draw force required for minimal draw string displacement has remained substantially the same. Curve "D" of FIG. 6 reflects a force profile for a conventional 55 pound recurve bow and "C" for a conventional 65 pound bow for comparison.

Figure 5:
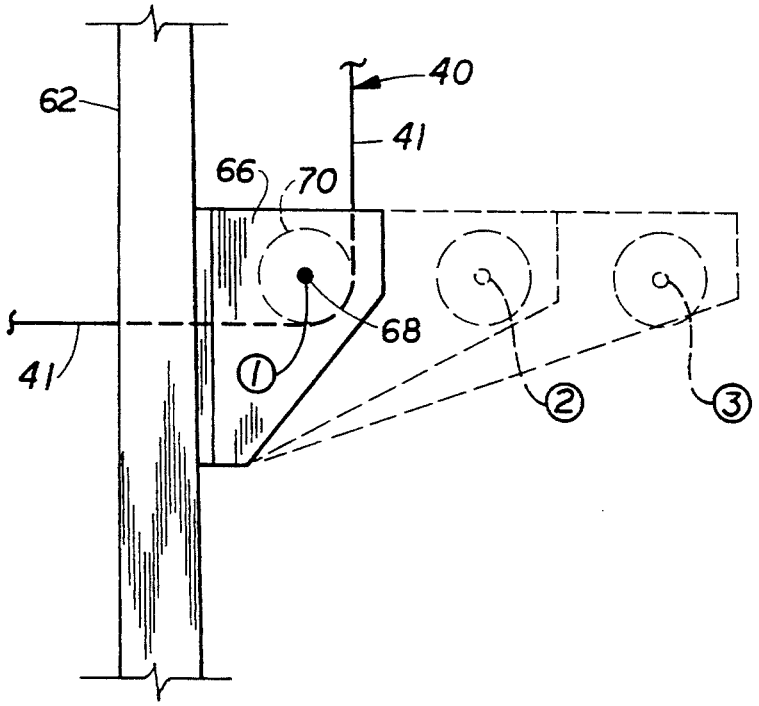
FIG. 5 is a detail of that which is shown in FIGS. 4 and 8, as alternatives.

Note the comparison between FIG. 3 and FIG. 5. Both show that the force profile in FIG. 6 can vary as per curves 1, 2 and 3. In FIG. 3, for example, this graphical data results from placement of cable 41 in bores 37 having 1, 2, and 3 corresponding to the graph of FIG. 6. Similarly, identical results stem from the FIG. 5 placement of idler 70 away from the limb 62, also denoted as 1, 2, and 3.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A recurve bow, comprising, in combination:

a central, substantially non-flexible handle having a top and bottom portion, an upper and lower limb, each said limb having a proximal extremity which is linked to said handle such that said upper limb extends directly from said top portion of said handle and said lower limb extends directly from said bottom portion of said handle, a draw string connecting said limbs at limb distal extremities which are remote from said handle, an upper pair and a lower pair of guide plates, said upper pair of guide plates connected directly to said top portion of said handle and said lower pair of guide plates connected directly to said bottom portion of said handle, said upper pair and said lower pair of guide plates each forming a channel within which a portion of said upper limb and said lower limb respectively are received, an upper cable attaching said upper limb to said handle and a lower cable attaching said lower limb to said handle, said upper and lower cable experience increasing tension upon cocking said bow with said draw string, whereby force required to cock the bow is partially provided by said upper cable and said lower cable being tensioned.

2. The bow of claim 1 wherein a force redirecting means extends between said guide plates, and said upper cable extends from an intermediate portion of said upper limb, above said handle towards said guide plates, over said force redirecting means and connects to said upper limb, and said lower cable extends from an intermediate portion of said lower limb, below said handle towards said guide plates, over said force redirecting means and connects to said lower limb, whereby each said limb is constrained with respect to said handle by each said cable running over respective said force redirecting means;

and a bearing surface between each said limb and said handle, defining a fulcrum.

3. The bow of claim 2 wherein one said limb touches said handle adjacent one said fulcrum, and a cam is provided attaching one end of one said cable to said one said limb.

4. The bow of claim 1 wherein said guide plates are formed on said handle on a side thereof adjacent said draw string, each said limb having a forward face which abuts against a complementally formed face of said handle, and a lower shoulder abutting against a lower wall of said handle, and a pair of ears disposed on each said limb rearwardly of said handle and which said ears supports thereon an axle over which said cable rides, said cable passing through said limb and to a forward portion of said handle, supported thereon by a cam means.

5. The bow of claim 4 wherein said limb includes a lower thick portion and an upwardly tapering portion, said ears provided just upstream from said lower thick portion, and said guide plates straddling said limb at said thick portion.

6. A method for assembling a bow having a handle and an upper and lower solitary limb to cock the bow, the steps including:

providing a fit between each bow limb and the bow handle itself, connecting each bow limb to the handle by an independent cable, running the cable from the handle to the limb, which cable is connected over a cam surface which alters force profiles as a function of cam position, connecting each bow limb to the handle by providing a pair of guide plates on opposed sides portions of both the limb and the handle, and connecting opposed extremities of the limbs to each other with a draw string.

7. The method of claim 6 including utilizing the entire limb and its flexing ability in order to improve the draw characteristics of the bow by not constraining the limb with respect to the bow as by bolting the limb to the bow.

8. The method of claim 7 including running one said cable from a surface of one said limb facing the drawstring, having said one said cable run to an end of said one said limb, and between a pair of ball bearings contained between seats formed on the handle and said one said limb, and directing said one said cable over a bottom surface of said one said limb and onto a surface of said one said limb remote from the drawstring, and fastening said one said cable thereto.

9. The method of claim 7 including directing one said cable on a side of one said limb adjacent the drawstring, altering the direction of said one said cable by passing said one said cable over an idler roller contained and supported on ears on the side of said one said limb facing the drawstring, directing said one said cable through said one said limb by providing a hole therethrough and terminating said one said cable on a surface of the handle remote from the drawstring, attaching said one said cable on the handle on a cam.

10. A bow formed from a drawstring and a handle having upper and lower limbs which touch said handle, and a pair of guide plates connecting an area between each said limb and said bow handle where said limbs touch said handle, one area where said handle and each said limb touch, defining a fulcrum area, one cable having a portion passing over each said fulcrum area, and means attaching each limb to said handle by said cable and near said fulcrum area.

11. The bow of claim 10 wherein said pair of guide plates are forwardly extending from the handle with respect to the bow's drawstring, said guide plates fastened to the handle by means of bolts, a pair of ball bearing existing between said fulcrum area, said cable running between said ball bearing pair.

12. The bow of claim 11 including an axle extending between said guide plates and over which said cable passes, said axle disposed at a lower most portion of said guide plates whereby said cable running from an upper limb portion, between said ball bearings, and over said axle, when fastened to said limb on an exterior face thereof, remote from the drawstring provides opposing force with respect to force required by the user in drawing the bowstring.

13. The bow of claim 12 wherein said axle supports said cable thereon through a groove.

14. The bow of claim 12 wherein said axle supports the cable thereon by means of a cam.

15. The bow of claim 11 wherein said guide plates are disposed on said handle at a surface thereof adjacent the drawstring, with a face of the limb remote from the drawstring in contacting with a trailing surface of the handle, and a shoulder of the handle supporting an end of the limb.

16. The bow of claim 15 including a pair of ears carried on a surface of the limb adjacent the drawstring, said ears supporting an axle thereon and said cable from an upper surface of said limb facing the drawstring, over the axle, and through the limb, through an orifice therethrough, to a forward portion of the handle.

17. The bow of claim 16 wherein said cable attaches to the handle via a cam type connector for altering cable tension.

18. A recurve bow comprising in combination:

a central handle having a top and bottom portion, a pair of limbs, each limb linked to said handle such that one said limb extends from said top portion of said handle and said other limb extends from said bottom portion of said handle, a draw string connecting said limbs' extremities remote from said handle, means to reduce the force required to cock the bow including:

an upper pair and a lower pair of guide plates, said upper pair of guide plates connected to said top portion of said handle and said lower pair of guide plates connected to said bottom portion of said handle, said upper pair and said lower pair of guide plates each forming a channel within which a portion of said upper limb and said lower limb respectively are received, an upper cable extending between said upper limb and said handle and a lower cable extending between said lower limb and handle, each said cable positioned at such a location that the upper and lower cables become tensioned upon cocking the bowstring, an axle extending between said guide plates; and said cable extending from an intermediate portion of one said limb, over said axle and connects to said limb, whereby each said limb is independently constrained with respect to said handle by said cable running over said axle, a bearing surface between each said limb and said handle defining a fulcrum, and said limb touches said handle adjacent said fulcrum, and a cam is provided attaching one end of said cable to said limb.

19. A recurve bow, comprising, in combination:

a central handle having a top and bottom portion, an upper limb and a lower limb linked to said handle such that said upper limb extends from said top portion of said handle and said lower limb extends from said bottom portion of said handle, a draw string connecting said limbs at limb extremities remote from said handle, an upper pair and a lower pair of guide plates, said upper pair of guide plates connected to said top portion of said handle and said lower pair of guide plates connected to said bottom portion of said handle, said upper pair and said lower pair of said guide plates each forming a channel within which a portion of said upper limb and said lower limb respectively are received, an upper cable attaching said upper limb and said handle, and a lower cable attaching said lower limb and handle, each said cable positioned such that said upper and lower cables become tensioned upon cocking the bowstring, said upper and lower limbs each having a forward face which abuts against a complementally formed face of the handle, and a shoulder abutting against a wall of the handle, and a pair of ears disposed on each said limb rearwardly of said handle and which said pair of ears supports thereon an axle over which said upper and lower cable, respectively, rides, each said cable passing through an adjacent said limb and to a forward portion of the handle, supported thereon by a cam means.

20. The bow of claim 19 wherein said limb includes a lower thick portion and an upwardly tapering portion, said ears provided just upstream from said lower thick portion, and said guide plates connecting said limb at said thick portion.

21. A recurve bow, comprising, in combination:

a central handle having a top and bottom portion, an upper limb and a lower limb linked to said handle such that said upper limb extends from said top portion of said handle and said lower limb extends from said bottom portion of said handle, a draw string connecting said limbs at limb extremities remote from said handle, an upper pair and a lower pair of guide plates, said upper pair of guide plates connected to said top portion of said handle and said lower pair of guide plates connected to said bottom portion of said handle, said upper pair and said lower pair of said guide plates each forming a channel within which a portion of said upper limb and said lower limb respectively are received, an upper cable attaching said upper limb to said handle, and a lower cable attaching said lower limb to said handle, said upper and lower cables experience increased tension upon cocking the bowstring, a bearing surface between each said limb and said handle, defining a fulcrum, and each said limb contacts said handle adjacent said fulcrum, whereby force required to cock the bow is partially provided by said upper cable and said lower cable being tensioned.

22. A recurve bow, comprising, in combination:

a central handle, a pair of limbs linked to said handle such that one said limb extends from a top portion of the handle and said other limb extends from a bottom portion of said handle, a draw string connecting said limbs at limb extremities remote from said handle, a means for minimizing the requisite force required to cock the bow in a drawn, cocked position from a force required to cock the bow without the force minimizing means, said force minimizing means operatively coupled between said handle and each said limb intermediate an extremity of each said limb distant from said handle, said limb having a forward face which abuts against a complementally formed face of the handle, and a lower shoulder abutting against a lower wall of the handle.

23. A method for altering a force profile required to deform a bow having a handle and an upper and lower solitary limb to cock the bow, the steps including:

providing an overlapping fit between each bow limb where it attaches to the bow handle, connecting each limb to the handle by an independent cable, running the cable from the handle to the limb, connecting opposed extremities of the limbs to each other with a draw string, whereby each cable independently altering the force profile required to bend each of the respective limbs via the draw string, providing a pair of guide plates on opposed side portions of both the limb and the handle, altering the tension on the cable by connecting the cable over a cam surface which alters force profiles as a function of cam position, utilizing the entire limb and its flexing ability in order to improve the draw characteristics of the bow by not constraining the limb with respect to the bow as by bolting the limb to the bow, running the cable from a surface of the limb at a point distal to the guide plates facing the draw string between a pair of ball bearings contained between seats formed on the handle and the limb, and directing the cable over a bottom surface of the limb and onto a surface of the limb remote from the draw string, proximal to the guide plates, and fastening the cable thereto.

24. A method for altering a force profile required to deform a bow having a handle and an upper and lower limb to cock the bow, the steps including:

providing an overlapping fit between each bow limb where it attaches to the bow handle, connecting each limb to the handle by a cable, running the cable from the handle to the limb, connecting opposed extremities of the limbs to each other with a draw string, whereby the cable alters the force profile required to bend the limbs via the draw string, providing a pair of guide plates on opposed side portions of both the limb and the handle, altering the tension on the cable by connecting the cable over a cam surface which alters force profiles as a function of cam position, utilizing the entire limb and its flexing ability in order to improve the draw characteristics of the bow by not constraining the limb with respect to the bow as by bolting the limb to the bow, directing the cable on a side of the limb adjacent the drawstring, altering the direction of the cable by passing the cable over an idler roller contained and supported on ears on the side of the limb facing the drawstring, directing the cable through the limb by providing a hole therethrough and terminating the cable on a surface of the handle remote from the drawstring, attaching the cable thereto on a cam adjustable surface.

25. A bow formed from a draw string and a handle having solitary upper and lower limbs, comprising in combination:

a pair of guide plates oriented at an area of interconnection between each limb and bow handle, a fulcrum area where each said limb touches said bow handle, a cable having a portion overlying said fulcrum area and having said portion of said cable sandwiched between the handle and each limb, and means attaching each limb to the handle with the cable.

26. The bow of claim 25 wherein said pair of guide plates are forwardly extending from said handle with respect to the bow's draw string, said guide plates fastened to said handle by means of bolts, a pair of ball bearing existing between said fulcrum area, said cable running between said ball bearing pair.

27. A recurve bow, comprising, in combination:

a central handle having a non-flexible top and bottom portion, a pair of solitary limbs, each said limb having an extremity and linked to said handle such that one said limb extends from said top portion of said handle and the other said limb extends from said bottom portion of said handle, an area of tangency on each said limb just below a fulcrum defined by a bearing surface between each said limb and said handle, and attachment means for an end of two cables, a draw string connecting said limbs at limb extremities remote from said handle, an upper pair and a lower pair of guide plates, said upper pair of guide plates connected to said top portion of said handle and said lower pair of guide plates connected to said bottom portion of said handle, said upper pair and said lower pair of said guide plates each forming a channel within which a portion of said upper limb and said lower limb respectively are received, an upper said cable attaching said upper limb to said handle and a lower said cable attaching said lower limb to said handle, said upper and lower cables experience tension upon cocking the bowstring, whereby force required to cock the bow is partially provided by said upper cable and said lower cable being tensioned.

28. The bow of claim 27 wherein each said limb has an area of tangency just below said fulcrum, and an adjustable means is provided attaching one end of each said cable to each said limb.

29. A method for altering a force profile required to deform a bow having a handle and an upper and lower solitary limb to cock the bow, the steps including:

providing an overlapping fit between each bow limb where it attaches to the bow handle, connecting each limb to the handle by an independent cable, running the cable from the handle to the limb, and connecting opposed extremities of the limbs to each other with a draw string, whereby each cable alters the force profile required to bend each of the respective limbs via the draw string, running the cable from a surface of the limb facing the draw string at a point of attachment distal to the overlapping fit between a pair of ball bearings contained between seats formed on the handle and the limb, and directing the cable over a bottom surface of the limb and onto a surface of the limb remote from the draw string, and fastening the cable thereto.

30. A recurve bow, comprising in combination:

a central non-flexible handle, a pair of solitary limbs, each said limb linked to said handle such that one said limb extends from a top portion of said handle and said other limb extends from a bottom portion of said handle, a bearing surface between each said limb and said handle, defining a fulcrum, upper and lower pairs of guide plates offset from said fulcrum, said upper pair located at said top portion of said handle, said lower pair located at said bottom portion of said handle, said upper and lower guide plates providing clearance to receive said respective upper and lower limbs therebetween.

31. A method for altering a force profile required to deform a recurve bow having a handle and an upper and lower singular limb to cock the bow the steps including:

providing an overlapping fit between each bow limb where it attached to the handle, connecting each limb to the handle by an independent cable, running the cable from the handle to the limb placing the cable between ball bearings placed between the handle and limb.

32. A method for altering a force profile required to deform a recurve bow having a handle and an upper and lower singular limb to cock the bow the steps including:

providing an overlapping fit between each bow limb where it attached to the handle, connecting each limb to the handle by an independent cable, running the cable from the handle to the limb placing the cable through the limb.

33. A kit which modifies a conventional bow formed from a draw string and a handle having upper solitary and lower limbs, comprising in combination:

a pair of guide plates adapted to straddle an area of interconnection between each limb and bow handle, said guide plates attached by suitable attachment means, a cable extending over a fulcrum area existing between the handle and each limb, and a pair of ball bearings nested between said fulcrum area wherein the cable passes between said bearing pair.

* * * * *